US006473905B1

(12) United States Patent
Katz

(10) Patent No.: US 6,473,905 B1
(45) Date of Patent: Nov. 5, 2002

(54) GARDENING GARMENTS

(76) Inventor: Susan A. Katz, 121 Painter Ridge Rd., Washington, CT (US) 06793

( * ) Notice: Subject to any disclaimer, the term of this patent is extended or adjusted under 35 U.S.C. 154(b) by 0 days.

(21) Appl. No.: 09/854,644

(22) Filed: May 14, 2001

(51) Int. Cl.[7] ..... A41D 13/04; A41D 13/06

(52) U.S. Cl. ..... 2/48; 2/24; 2/51; 2/74; 2/215

(58) Field of Search ..... 2/48, 51, 24, 46, 2/22, 23, 47, 52, 62, 69, 71, 72, 74, 75, 77, 79, 80, 94, 105, 115, 211, 213, 214, 215, 227, 228, 231, 232, 238, 242; D2/860, 861, 863, 864

(56) References Cited

U.S. PATENT DOCUMENTS

| | | | | | |
|---|---|---|---|---|---|
| 401,078 | A | * | 4/1889 | Smith et al. | 2/47 |
| 431,332 | A | | 7/1890 | Chadwick | |
| 889,470 | A | * | 6/1908 | Lyons | 2/51 |
| 1,004,717 | A | * | 10/1911 | White | 2/24 |
| 1,451,095 | A | * | 4/1923 | Greene | 2/51 |
| 1,482,777 | A | * | 2/1924 | Becton | 2/24 |
| 1,521,121 | A | * | 12/1924 | Nelson | 2/47 |
| 1,524,457 | A | * | 1/1925 | Selander | 2/51 |
| 1,669,085 | A | * | 5/1928 | Guyon | 2/23 |
| 1,675,072 | A | | 6/1928 | Watermon | |
| 1,816,566 | A | * | 7/1931 | Burstein et al. | 2/48 |
| 1,863,527 | A | * | 6/1932 | Stern | 2/48 |
| 1,979,879 | A | * | 11/1934 | Harris | 2/48 |
| 2,100,817 | A | * | 11/1937 | Quinn | 2/48 |
| D133,954 | S | | 9/1942 | Siegle | |
| 2,538,677 | A | | 1/1951 | Ferrand | |
| 2,570,848 | A | * | 10/1951 | Ozenberger | 2/48 |
| 2,666,920 | A | * | 1/1954 | Lang | 2/48 |
| 3,428,962 | A | | 2/1969 | Slimovitz | |
| 3,535,709 | A | | 10/1970 | Johannes | |
| 3,624,686 | A | | 11/1971 | Beals | |
| D257,596 | S | | 12/1980 | Rosenbloom, III | |
| 4,637,075 | A | | 1/1987 | Ingrisano et al. | |
| 4,831,666 | A | | 5/1989 | Denman | |
| 4,920,577 | A | * | 5/1990 | Scharf | 2/24 |
| 4,977,626 | A | | 12/1990 | Smith | |
| 5,024,361 | A | | 6/1991 | Flowers | |
| 5,038,408 | A | * | 8/1991 | DeBaene | 2/51 |
| 5,107,545 | A | | 4/1992 | Potter | |
| 5,566,391 | A | | 10/1996 | Williamson | |
| D399,336 | S | | 10/1998 | De Fino | |
| 6,338,164 | B1 | * | 1/2002 | Howard | 2/23 |

* cited by examiner

*Primary Examiner*—Amy B. Vanatta
(74) *Attorney, Agent, or Firm*—Bachman & LaPointe, P.C.

(57) ABSTRACT

The present invention relates to garments which have particular use during gardening activities. The garments each broadly comprise a protective panel to be worn in the front of the user, at least one pad connected to the protective panel for protecting a user's knees when kneeling, and devices for holding implements that may be needed by the user attached to the protective panel. The holding devices may comprise straps secured to the protective panel, pockets attached to the protective panel, and/or VELCRO tabs attached to the protective panel.

22 Claims, 6 Drawing Sheets

GARDENING GARMENTS

BACKGROUND OF THE INVENTION

The present invention relates to garments which can be worn during gardening activities and other activities. The garments include a shirt and an apron.

Protective aprons are well known in the art. They have been used in many different environments to protect a wearer's clothing. Known apron-type garments include painting aprons, mechanic's aprons, fishing aprons, and home keeper aprons. The patent literature illustrates many different types of aprons. For example, U.S. Design Pat. No. 133,954 to Siegle illustrates a mechanic's apron and U.S. Design Pat. No. 257,596 to Rosenbloom III illustrates a work apron. Both aprons include a plurality of pockets for storing items.

U.S. Pat. No. 431,332 to Chadwick illustrates an apron to be worn by either children or adults. The apron consists of a body adapted to cover the front of a garment combined with tubular sleeve protectors permanently connected by straps to the respective shoulders of the apron.

U.S. Pat. No. 1,675,072 to Watermon illustrates a surveyor's apron designed to be attached to a body supporting belt and adapted to have a series of pockets secured thereto for the purpose of carrying tools and small articles that are used by those engaged in the trade. The apron has a spring reel secured thereto having a winding cord attached to a plumb-bob and a holder for the plumb-bob.

U.S. Pat. No. 2,538,677 to Ferrand illustrates an article holding apron for stream fishermen. The apron includes a plurality of pockets having closure flaps that receive fishing articles such as lures, plugs, hooks, sinkers, and the like. The apron further includes harness means so that it is adaptable to fit persons of various sizes and may be adjusted to fit high on a user's chest to prevent engagement of water therewith when the user is stream fishing.

U.S. Pat. No. 3,428,962 to Slimovitz illustrates a barbecue apron having pockets and VELCRO strips for securing mittens to the apron.

U.S. Pat. No. 3,535,709 to Johannes illustrates a painter's apron comprising a generally planar panel of paint-impervious material adapted to overlie the front of the user's torso, means for securing the panel in position, an upwardly opening paint reservoir extending the full width of the panel and having its upper rearward edge secured to the lower edge of the panel, and resilient paint brush retaining means attached to the forward surface of the panel above the reservoir and operable to support a paint brush releasably with its handle uppermost.

U.S. Pat. No. 3,624,686 to Beals relates to a pocket apron for teaching color recognition. The apron has strips of attachment material thereon with cooperating strips of pressure sensitive material on the backside of a multitude of pockets for removable attachment to the apron body. The pockets are of various colors for the teaching of color recognition.

U.S. Pat. No. 4,977,626 to Smith relates to an apron like garment having a pocket dispenser formed by two overlaid panels, one of which is partially detachable.

U.S. Pat. No. 5,107,545 to Potter relates to a fisherman's fly tying apron which includes an upper section having means for attaching the apron to a user, a lower section detachable from the upper section, a waste collecting means associated with the lower section, and a stiffening means associated with either the lower section or the waste collecting means.

U.S. Pat. No. 5,566,391 to Williamson relates to a painting apron with an onboard paint supply. The apron has a protective sheet of flexible, paint-impervious material to which a mounting arrangement is secured. The mounting arrangement includes an expandable loop which releasably receives a paint container including a cup portion and a removable lid portion which is tethered to the cup portion. The apron is secured to the wearer via a strap arrangement including one or more elongate straps which extend from the protective sheet.

U.S. Pat. No. 5,024,361 to Flowers illustrates a supply caddy having a main body portion defining a pocket which is selectively subdivided by vertical and horizontal strips which are repositionable within the pocket. The caddy may be attached to a wearer by a strap.

U.S. Pat. No. 4,637,075 to Ingrisano et al. illustrates a vest garment to be worn by emergency medical services personnel. The garment includes a number of pockets and clips for carrying emergency medical supplies and equipment.

Various gardening garments are also known in the prior art. U.S. Design Pat. No. 399,336 to DeFino illustrates one such garment. U.S. Pat. No. 4,831,666 to Denman illustrates a pants garment adapted to provide protection to a person's knees while performing gardening tasks. The garment has a pair of legs and a pocket affixed to the exterior of each leg. A padded cushioning member is substantially fixedly held in each pocket.

Despite the existence of these aprons and garments, there remains a need for practical and useful garments to be worn during gardening and other activities.

SUMMARY OF THE INVENTION

Accordingly, it is an object of the present invention to provide a garment to be worn by a user during activities which may require the user to assume a kneeling position.

It is a further object of the present invention to provide a garment as above which is provided with pockets and other devices for holding tools, materials, and other implements.

It is yet a further object of the present invention to provide a garment as above which may be worn during gardening activities.

It is still a further object of the present invention to provide a garment as above which may be readily cleaned and reused.

The foregoing objects are met by the garments of the present invention.

In accordance with the present invention, a garment broadly comprises a protective panel to be worn in the front of a user, means for protecting a user's knees secured to the protective panel, and means for holding implements which may be used by the user secured to the protective panel. In several embodiments of the present invention, the garment takes the form of a gardening apron. In other embodiments of the present invention, the garment takes the form of a gardening shirt.

Other details of the gardening garments of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
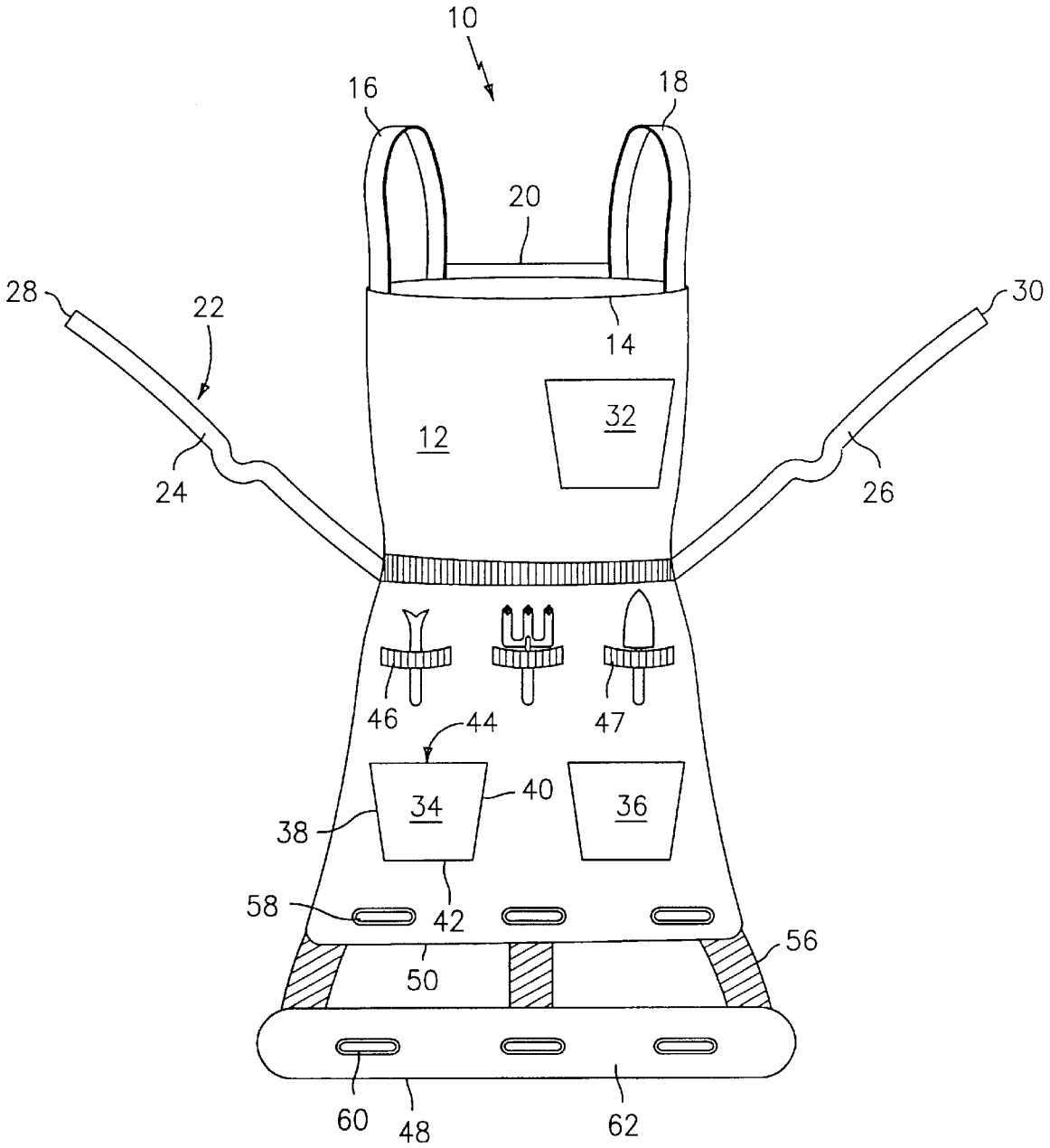
FIG. 1 is a perspective view of a first embodiment of a gardening apron in accordance with the present invention.

Referring now to the drawings, FIG. 1 illustrates a first embodiment of a garment in accordance with the present invention. The garment is a gardening apron 10 having a front protective panel 12 for protecting clothing being worn by a user. The front protective panel 12 may be formed from any suitable material known in the art. For example, the material forming the panel 12 may be a material which is water-impervious or non-water-impervious. Preferably, the material forming the panel 12 may be easily cleaned, such as by putting it into a household laundry machine, so that the apron can be cleaned and reused.

As can be seen from FIG. 1, the protective panel 12 extends from a region where it protects the user's chest to a region above the knees of the user. Attached to an upper edge 14 of the panel 12 are first and second shoulder straps 16 and 18. The straps 16 and 18 may be secured to the upper edge 14 of the panel using any suitable means known in the art such as by stitching. The straps 16 and 18 are joined together by a third strap 20 which is positioned at the rear of the user. The strip 20 may be stitched to both straps 16 and 18 or, alternatively, may be sewn to one of the straps 16 and 18 and releasably secured to the other of the straps 16 and 18 such as by snaps, buttons, VELCRO, a hook and latch mechanism, etc. The straps 16, 18 and 20 allow the apron 10 to be supported by a user's shoulders. They also allow the apron 10 to be easily removed from about the user's neck. The straps 16, 18, and 20 may be formed from the same material as the panel 12 or from a different material.

The apron 10 is also provided with a belt 22 in a central region of the protective panel 12. The belt 22 may be formed from a first length 24 of material and a second length 26 of material. The first and second lengths 24 and 26 may be joined to the protective panel 12 using any suitable means known in the art. For example, they could be sewn to the protective panel 12. The free ends 28 and 30 of the lengths 24 and 26 may be positioned around the waist of a user and joined together such as by tying the free ends 28 and 30 together. If desired, the first and second lengths 24 and 26 may be replaced by a second length of material attached to the protective panel 12.

The apron 10 is provided with pockets 32, 34, and 36 for holding gardening implements such as packets of seed, gloves, tools, etc. The pockets 32, 34, and 36 are each preferably formed by a piece of material secured to the protective panel along side edges 38 and 40 and a bottom edge 42. By forming the pockets in this manner, an upper opening 44 is provided which allows access to the interior of the pocket.

The apron 10 further has a plurality of straps 46 for holding gardening tools such as a rack, clippers, shovel, etc. Each of the straps 46 may be secured at one end to the protective panel 12 such as by sewing. The other end of each strap 46 may be secured at a second end to the protective panel via a release mechanism 47 such as a hook and latch mechanism. The release mechanism 47 is provided so that the tools may be easily removed and/or repositioned in place. If desired, the straps 46 may be provided with elastic so as to better grip the tools.

Figure 2:
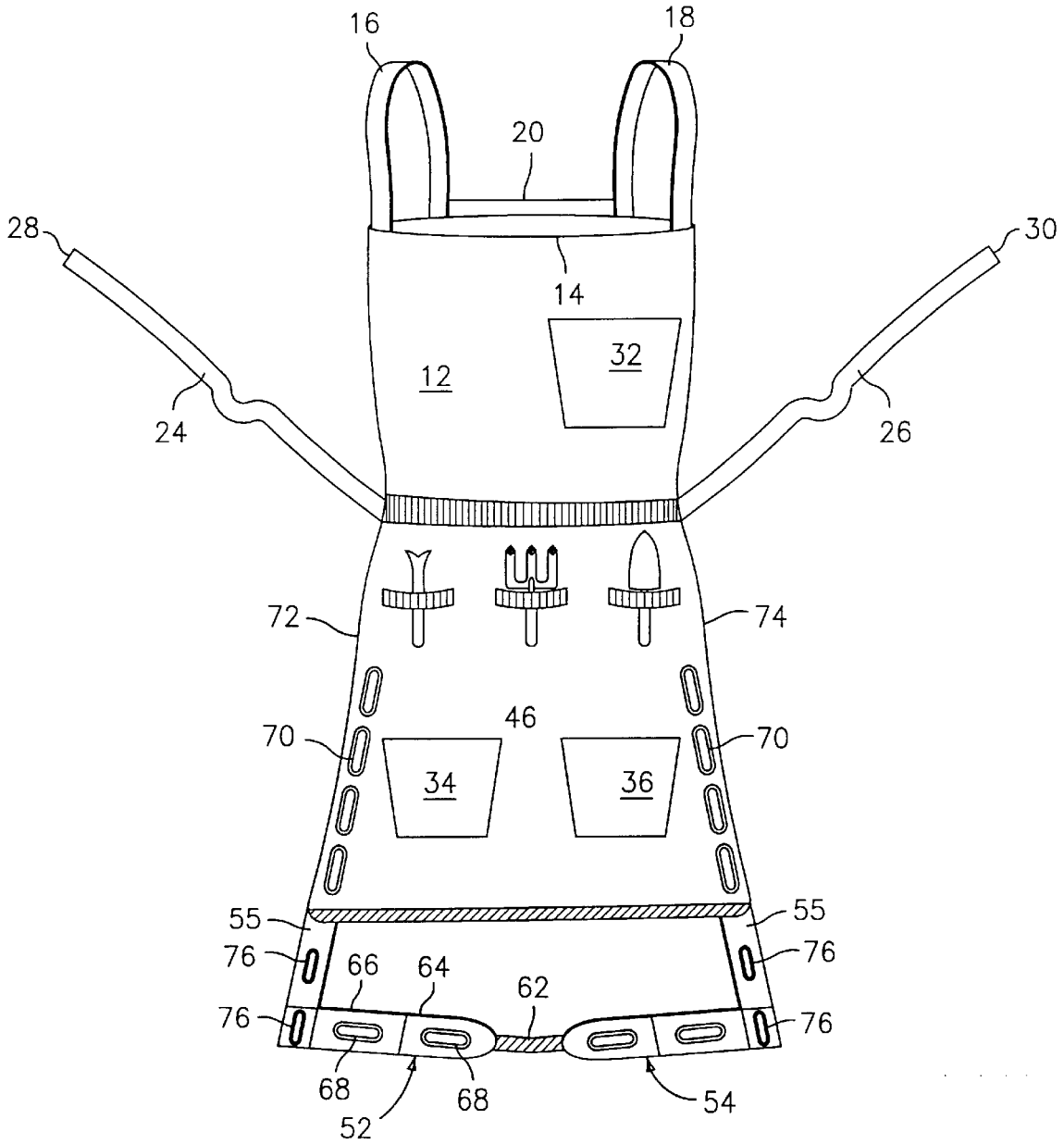
FIG. 2 is a perspective view of a second embodiment of a gardening apron in accordance with the present invention.

When performing gardening activities, it is often necessary for a user to assume a kneeling position. Over time, a user's knees become sore and/or scraped from contacting rocks in the garden or from contacting the ground for prolonged periods of time. To reduce the impact of having to assume a kneeling position, a kneeling pad 48 is attached to a lower edge 50 of the apron 10. The kneeling pad 48 may be a continuous member as shown in FIG. 1 or may be formed from first and second foldable kneeling pads 52 and 54 as shown in FIG. 2. The kneeling pad 48 may be joined to the lower edge 50 using any suitable means known in the art. For example, a continuous kneeling pad 48 may be joined to the lower edge 50 by a plurality of spaced apart elastic straps 56.

If desired, a plurality of aligned VELCRO securing devices 58 may be provided adjacent the lower edge 50. Mating VELCRO securing devices 60 may be provided on the exterior surface 62 of the pad 48. If desired, a user could fold the kneeling pad 48 and secure it to the devices 58 via the devices 48. Alternatively, the securing devices 58 and 60 may be used to secure other gardening implements to the front panel 12 or the kneeling pad 48.

Referring now to FIG. 2, an alternative embodiment of a gardening apron 10 is illustrated. This embodiment is substantially the same as the embodiment of FIG. 1 with one notable exception. As previously discussed, the kneeling pad 48 of FIG. 1 is replaced by first and second foldable kneeling pads 52 and 54 in this embodiment. The kneeling pads 52 and 54 are joined to the lower edge 50 of the panel 12 by elastic straps 55.

During use, the kneeling pads 52 and 54 may be joined together using any suitable means known in the art. For example, a strap 62 may be provided having VELCRO type or snap type securing devices at each end. Each of the pads 52 and 54 may have mating securing devices for allowing the strap 62 to be secured to each of the pads 52 and 54. If desired, the strap 62 may be omitted and the pads 52 and 54 may be directly joined to each other by suitable securing devices.

If desired, each of the pads 52 and 54 may be formed from a plurality of panels 64 and 66. The panels 64 and 66 are preferably constructed so that the panel 64 may fold back onto the panel 66 when the kneeling pad is not being used. To secure the panel 64 to the panel 66, VELCRO type securing devices 68 may be provided on each of the panels 64 and 66.

The apron 10 in the embodiment of FIG. 2 is also preferably provided with a plurality of aligned VELCRO type securing devices 70 along each of the side edges 72 and 74 of the panel 12. The securing devices 70 may be used to mate with similar type securing devices 76 on the straps 55. In this way, the kneeling pads 52 and 54 may be moved into a retracted position where they do not contact a user's knees. In addition to mating with the devices 76, the securing devices 70 may also be used to hold implements being used by the user.

Figure 3:
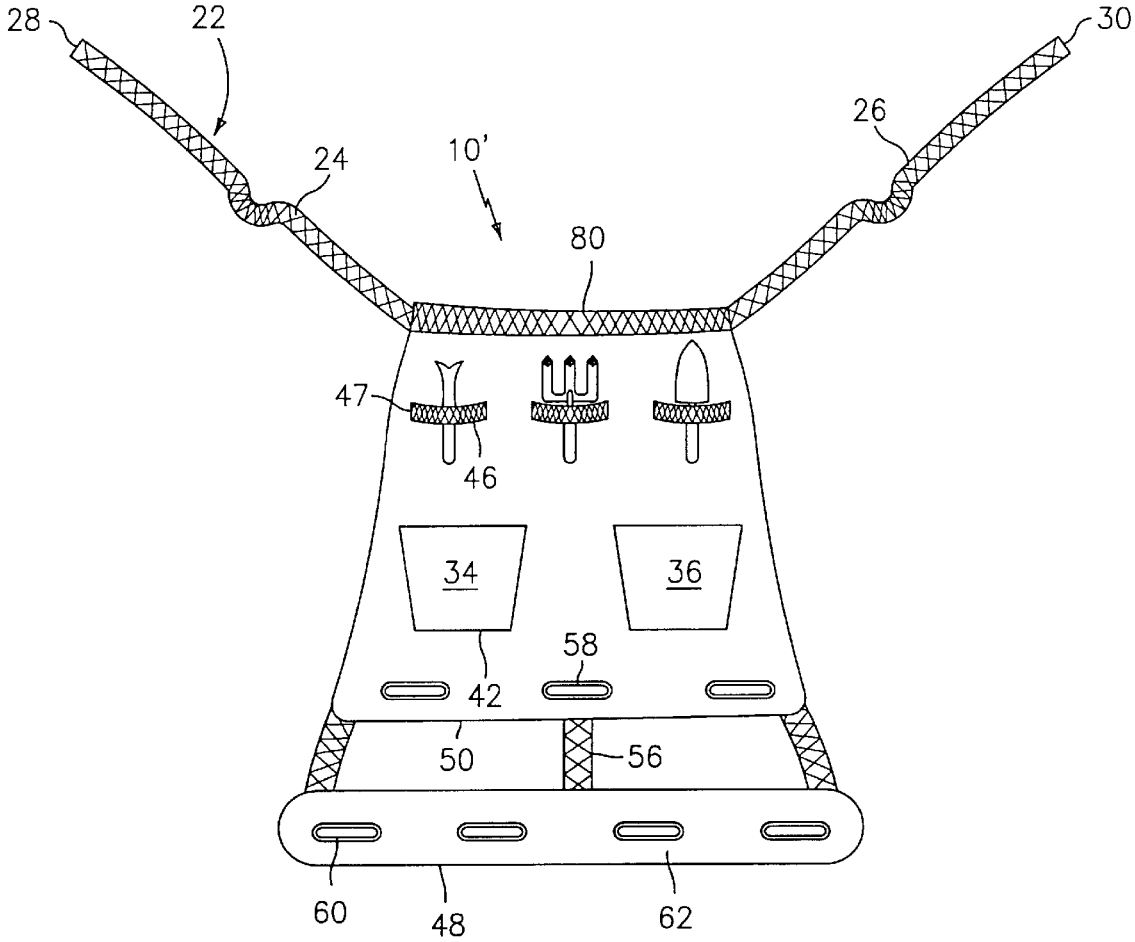
FIG. 3 is a front view of a third embodiment of a gardening apron in accordance with the present invention.

FIG. 3 illustrates yet another embodiment of a gardening apron 10'. The gardening apron 10' is similar in construction to the gardening apron 10 of FIG. 1 with certain exceptions. In this embodiment, the upper portion of the protective panel 12 and the shoulder straps 16, 18, and 20 have been omitted. As a result, the upper edge 80 of the apron 10' at least partially encircles the waist of a user. Also, in this embodiment, the belt 22 is joined to the apron 10' substantially at the upper end 80.

Figure 4:
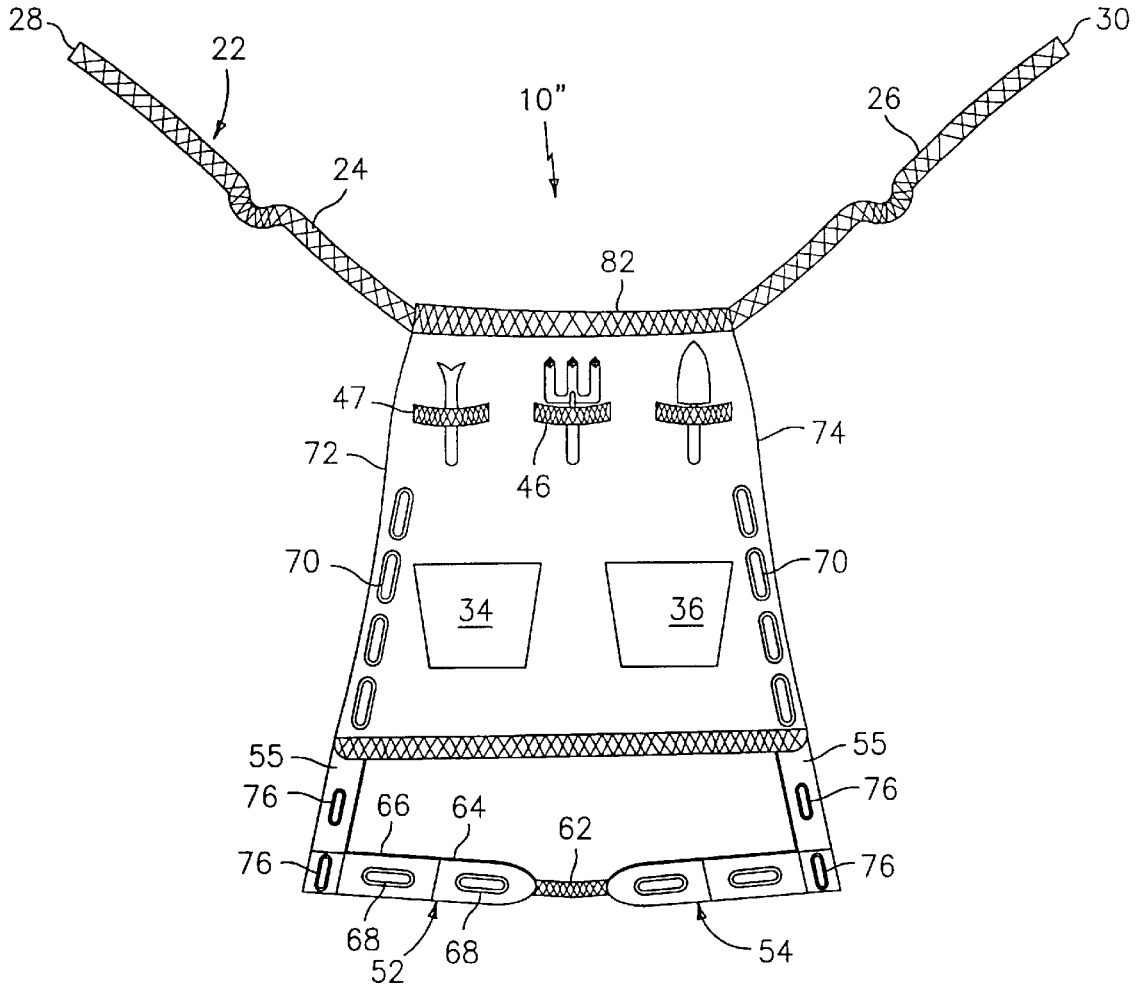
FIG. 4 is a front view of a fourth embodiment of a gardening apron in accordance with the present invention.

Referring now to FIG. 4, yet another embodiment of an apron 10" in accordance with the present invention is illustrated. The gardening apron 10" is similar in construction to the gardening apron of FIG. 2 with certain exceptions. Here again in this embodiment, the upper portion of the protective panel 12 and the straps 16, 18 and 20 have been omitted. As in FIG. 3, the upper edge 82 of the apron 10" at least partially encircles the waist of a user. Also in this embodiment, the belt 22 joins the protective panel 12 substantially at the upper edge 82.

Figure 5:
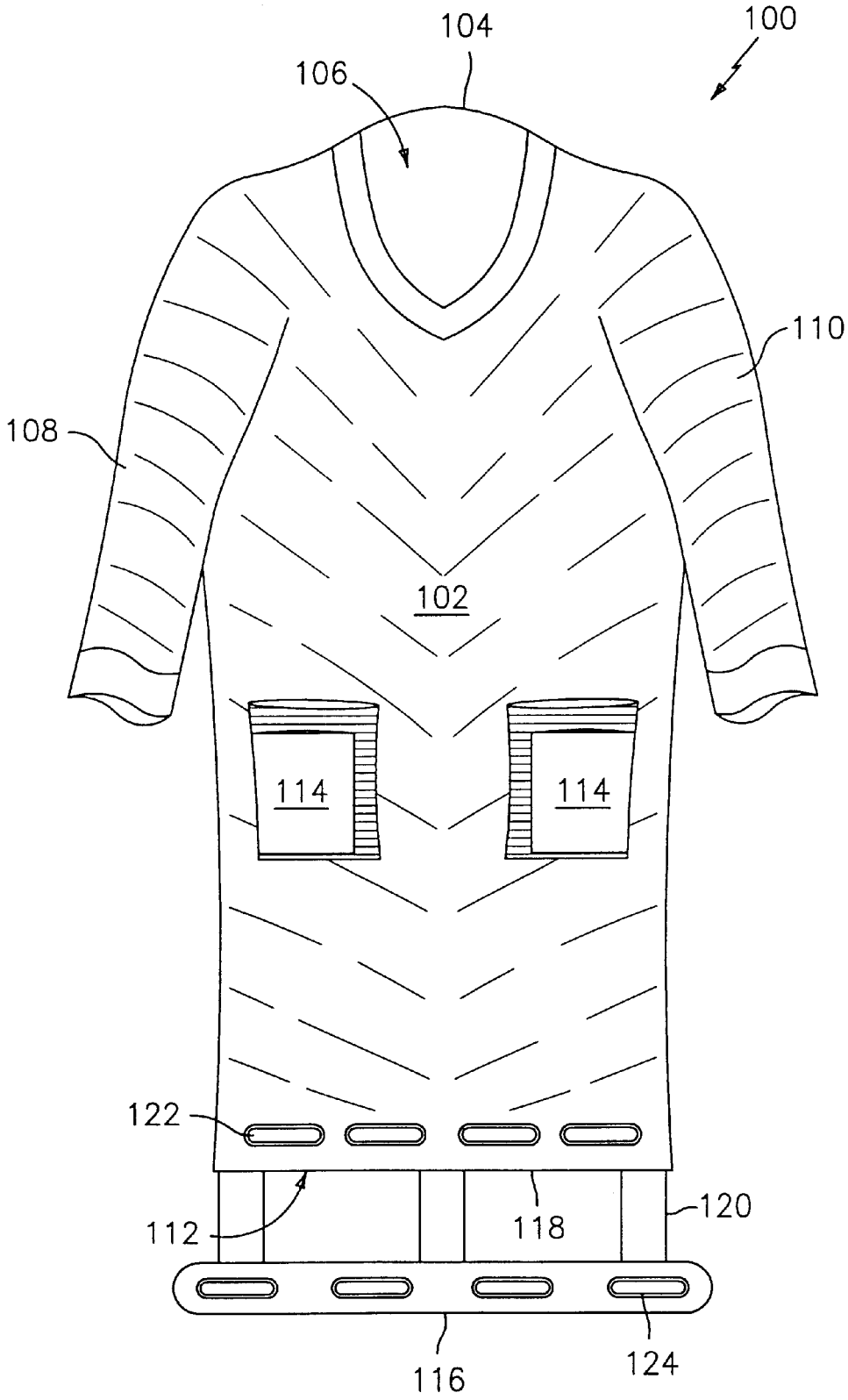
FIG. 5 is a front view of a first embodiment of a gardening shirt in accordance with the present invention.

Referring now to FIG. 5, a gardening shirt 100 is illustrated. The gardening shirt 100 is formed by a first piece of material forming a front protective panel 102 and a second piece of material forming a rear protective panel 104. The first and second pieces of material may be joined to each other using any suitable means known in the art. For example, they can be sewn to each other. When joined together, the first and second pieces of material form a neck opening 106, sleeves 108 and 110, and a lower opening 112. The shirt 100 may be put on by slipping the user's body into the opening 112, inserting the user's arms into sleeves 108 and 110, and inserting the user's head through the neck opening 106.

The shirt 100 may have a number of pockets 114 for holding gardening implements. The pockets 114 may be formed by securing one or more pieces of material to the piece of material forming the front protective panel 102 along the side edges and the bottom edges of the piece of material such as by sewing.

The shirt 100 is provided with a continuous kneeling pad 116. The continuous kneeling pad 116 is secured to the lower edge 118 by a plurality of elastic straps 120. The front protective panel 102 is provided with a plurality of securing devices 122, such as VELCRO type devices or snaps, along a lower portion substantially adjacent the lower edge 118. The pad 116 is formed with a plurality of mating securing devices 124, such as VELCRO type devices or snaps, on at least one surface. When in use, the kneeling pad 116 hangs suspended from the lower edge 118 of the shirt 100 by the straps 120 and when not in use, the kneeling pad 116 may be secured to a retracted position by the securing devices 122 and 124. It should be noted that the securing devices 122 may be used to secure gardening implements if desired.

Figure 6:
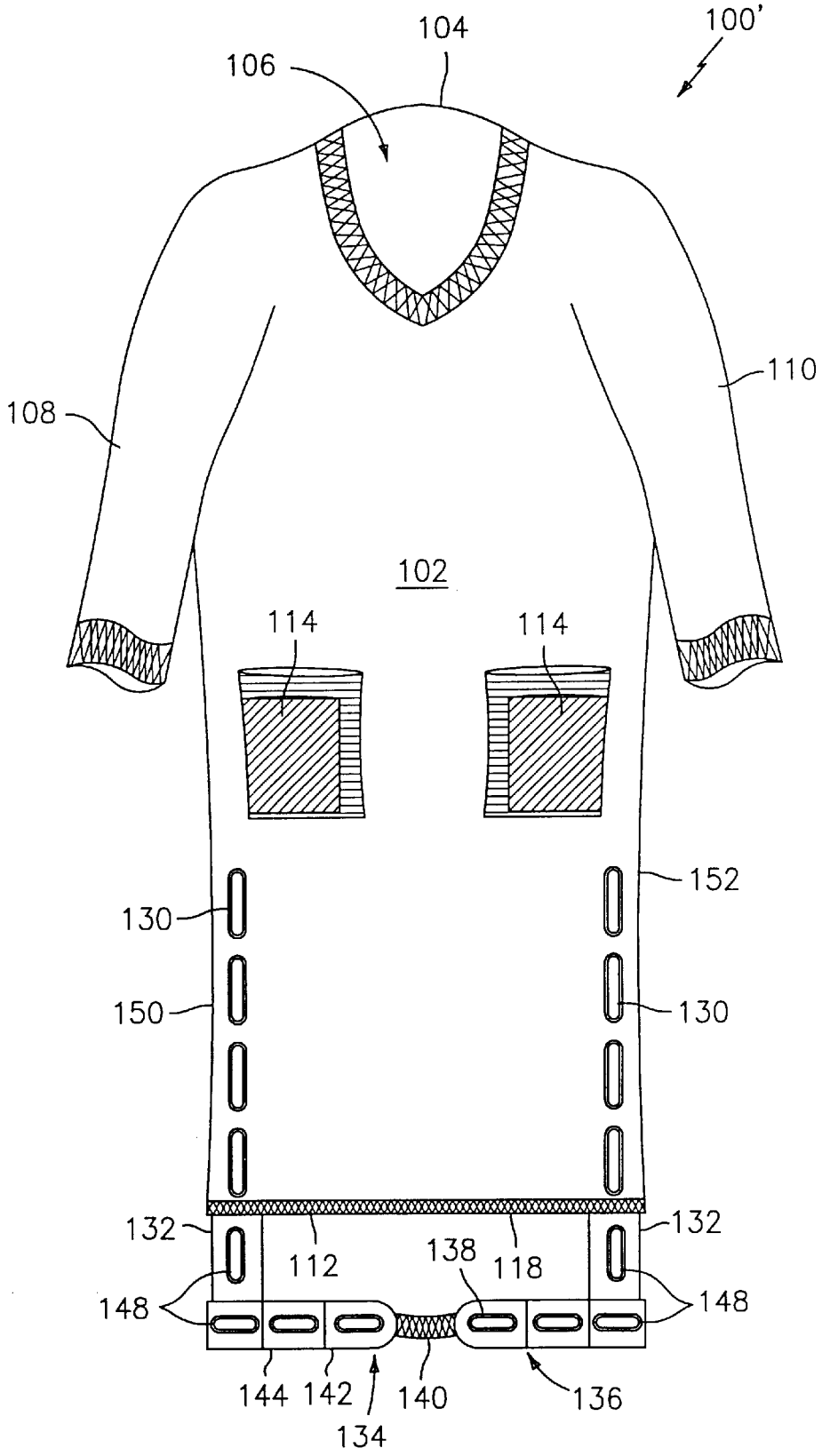
FIG. 6 is a front view of a second embodiment of a gardening shirt in accordance with the present invention.

Referring now to FIG. 6, an alternative embodiment of a gardening shirt 100' is illustrated. The shirt 100' is similar in construction to the shirt 100. It has a first piece of material forming a front protective panel 102 and a second piece of material forming a rear protective panel 104. The first and second pieces of material are joined together, such as by sewing, to form a neck opening 106, sleeves 108 and 110, and lower opening 112. Further, one or more pieces of material may be sewn to the front protective panel to form pockets 114.

The shirt 100' differs from the shirt 100 in the provision of a kneeling pad formed from first and second kneeling pads 134 and 136. Each of the kneeling pads 134 and 136 may be joined to a lower edge 118 of the shirt 100' by elastic straps 132. Preferably, each of the kneeling pads 134 and 136 is foldable. To this end, each of the kneeling pads 134 and 136 may be formed by a plurality of panels 142 and 144. Each of the panels 142 and 144 is provided with a securing device 138, such as a VELCRO type of material or a snap, to allow it to be folded and joined to the other of the panels 142 and 144. As before, a connecting strap 140 is provided to join the panels 134 and 136 together during use. The connecting strap 140 may have any suitable means known in the art to secure it to both of the panels 134 and 136.

The shirt 100' has a plurality of securing devices 130 along opposed sides 150 and 152. The securing devices may be used to hold gardening implements. Alternatively, they can be used to mate with securing devices 148 to maintain the kneeling pads 134 and 136 in a retracted position when not needed.

Each of the padded kneeling pads 48, 52, 54, 116, 134, and 136 may be formed using any suitable construction known in the art. For example, each of the kneeling pads 48, 52, 54, 116, 134, and 136 may comprise a layer of cushioning material sandwiched between two fabric layers.

While the kneeling pads 52, 54, 134, and 136 have been illustrated as being formed from two foldable panels, they each could be formed from any desired number of foldable panels.

The elastic straps 55, 56, 120, and 132 in the various embodiments of the present invention allow the kneeling pads to be adjusted to each user as needed as a result of their ability to expand and retract. They also allow the kneeling pads to be moved between operational positions where a user kneels on them and a retracted or inoperative position where they do not bang on a user's knees as he/she is walking.

The gardening garments of the present invention have a number of advantages. Most notably, they allow a wearer to store needed gardening implements in easily accessible locations on the garment. They also allow the wearer to substantially prevent knee damage which may be caused by placing one's knee on an uncushioned surface for prolonged periods of time. Still further, they allow a wearer to move the knee protection equipment to a retracted or inoperative position so as to not interfere with normal activities such as walking. Still further, the garments may be easily cleaned and reused.

While the garments of the present invention have been described in the context of being used during gardening activities, it should be readily apparent that the garments could also be worn during the performance of other chores including, but not limited to, washing floors, cleaning homes and other facilities, repairing homes and other facilities, and painting homes and other facilities. The garments of the present invention have utility wherever one needs to protect other garments and needs to provide cushioning for one's knees.

It is apparent that there has been provided in accordance with the present invention gardening garments which fully satisfy the objects, means, and advantages set forth hereinbefore. While the present invention has been described in the context of specific embodiments thereof, other alternatives, modifications and variations will become apparent to those skilled in the art having read the foregoing description. Therefore, it is intended to embrace such alternatives, modifications, and variations as fall within the broad scope of the appended claims.

What is claimed is:

1. A garment comprising:

a protective panel to be worn in the front of a user;

means for protecting the user's knees;

said protecting means having an upper edge positioned below and spaced from a bottom edge of said protective panel;

said protecting means being attached to said bottom edge of said protective panel; and means for holding implements that may be needed by the user, said implement holding means being attached to the protective panel.

2. A garment according to claim 1, wherein said means for protecting a user's knees comprises a padded knee pad secured to said protective panel.

3. A garment comprising:

a protective panel to be worn in front of a user;

means for protecting the user's knees, said protecting means being attached to said protective panel;

means for holding implements that may be needed by the user, said implement holding means being attached to said protective panel;

said means for protecting a user's knees comprises a padded knee pad secured to said protective panel; and a plurality of elastic straps for securing said padded knee pad to said protective panel.

4. A garment according to claim 3, wherein said padded knee pad has a first padded portion, a second padded portion, and means for securing the first padded portion to the second padded portion.

5. A garment according to claim 3, wherein said knee pad is foldable.

6. A garment according to claim 3, wherein said implement holding means comprises at least one strap secured to said protective panel.

7. A garment according to claim 6, wherein said implement holding means comprises a plurality of aligned straps.

8. A garment according to claim 6, wherein said implement holding means further comprises at least one pocket.

9. A garment according to claim 6, wherein said implement holding means comprises a plurality of securing devices.

10. A garment according to claim 9, wherein said securing devices include a first set of securing devices aligned along a first side of said protective panel and a second set of securing devices aligned along a second side of said protective panel.

11. A garment according to claim 9, wherein said plurality of securing devices are positioned adjacent a lower edge of said protective panel and are aligned with each other.

12. A garment according to claim 3, wherein said garment is an apron and wherein a belt is secured to an upper edge of said protective panel.

13. A garment according to claim 3, further comprising first and second straps to be placed over a user's shoulder's secured to an upper edge of said protective panel.

14. A garment according to claim 13, further comprising a third strap for connecting said first and second strap and said third strap being worn on the rear of a user.

15. A garment according to claim 13, further comprising said protective panel covering the chest of the user and a belt affixed to a central portion of said protective panel.

16. A garment according to claim 3, wherein said garment comprises a shirt having a front portion formed by said protective panel, a rear portion connected to said front portion, and an open neck portion for allowing the shirt to be slipped over a user's head.

17. A garment according to claim 16, wherein said knee protecting means are connected to said protective portion by a plurality of elastic straps.

18. A garment according to claim 16, wherein said knee protecting means comprises first and second padded kneeling pads and means for securing the first and second pads together.

19. A gardening apron comprising:

a front protective panel;

means for holding gardening implements secured to said front protective panel;

means for protecting a user's knees during kneeling;

said knee protecting means having an upper edge positioned beneath and spaced from a lower edge of said front protective panel;

said knee protecting means being secured to said front protective panel;

a belt for securing said apron around a user's waist.

20. A gardening apron according to claim 19, further comprising first and second straps for allowing said apron to be supported by a user's shoulders.

21. A gardening apron according to claim 19, wherein said knee protecting means comprises at least one padded kneeling pad.

22. A gardening apron according to claim 19, wherein said knee protecting means comprises first and second padded kneeling pads and means for securing said first pad to said second pad during use.

* * * * *